US005911750A

United States Patent [19]

Mandel et al.

[11] Patent Number: 5,911,750

[45] Date of Patent: Jun. 15, 1999

[54] AIR FLOW SYSTEM FOR REFRIGERATOR FREEZER COMPARTMENT

[75] Inventors: Sheldon W. Mandel, East Galesburg; Scott T. Tunzi, Galesburg; Kyle Bryant VanMeter, Galesburg; Robert C. Zimmerman, Galesburg, all of Ill.; Paul V. Sikir, Madison, Wis.

[73] Assignee: Maytag Corporation, Newton, Iowa

[21] Appl. No.: 08/869,252

[22] Filed: Jun. 4, 1997

[51] Int. Cl.[6] ..... F25D 17/04

[52] U.S. Cl. ..... 62/407; 62/89

[58] Field of Search ..... 62/404, 407, 408, 62/419, 455, 89

[56] References Cited

U.S. PATENT DOCUMENTS

| | | | |
|---|---|---|---|
| 2,318,222 | 5/1943 | Heisler . | |
| 2,450,823 | 10/1948 | Bauman . | |
| 2,912,834 | 11/1959 | Mann . | |
| 2,991,630 | 7/1961 | Wurtz | 62/156 |
| 3,092,220 | 6/1963 | Black . | |
| 3,107,502 | 10/1963 | Herndon, Jr. et al. . | |
| 3,321,933 | 5/1967 | Scheitlin et al. . | |
| 3,365,118 | 1/1968 | Winfield, Jr. . | |
| 4,845,957 | 7/1989 | Richardson | 62/255 |
| 4,920,765 | 5/1990 | McCauley et al. | 62/408 |
| 4,944,157 | 7/1990 | Jenkins et al. | 62/407 |
| 5,101,643 | 4/1992 | Hicke | 62/407 |
| 5,357,769 | 10/1994 | Crabtree et al. . | |
| 5,369,963 | 12/1994 | Pickles et al. | 62/408 |
| 5,715,703 | 2/1998 | Kopf et al. | 62/455 |

*Primary Examiner*—William Doerrler
*Attorney, Agent, or Firm*—Everett G. Diederiks, Jr.

[57] ABSTRACT

An air flow system for the freezer compartment of a refrigerator includes air inlets located at an upper rear portion of the freezer compartment which direct a supply of cooling air forward and against both top and side walls of the compartment. The air then flows along an upper portion of the compartment toward a front thereof where it is re-directed downward and rearward. The bottom wall of the freezer compartment is provided with a plurality of upstanding, laterally spaced ribs upon which food items can be supported. Since the ribs are spaced, numerous channels are formed which extend from the front portion of the compartment to adjacent the rear wall. A gap is preferably created between the rear wall and the ends of the ribs such that air is permitted to flow laterally along a lower rear portion of the compartment. Air outlets or returns are also provided in the lower rear portion of the compartment for recycling of the air. With this arrangement, an effectively distributed and enhanced circulating flow of cooling air is created to efficiently maintain stored food items at a desired temperature.

17 Claims, 2 Drawing Sheets

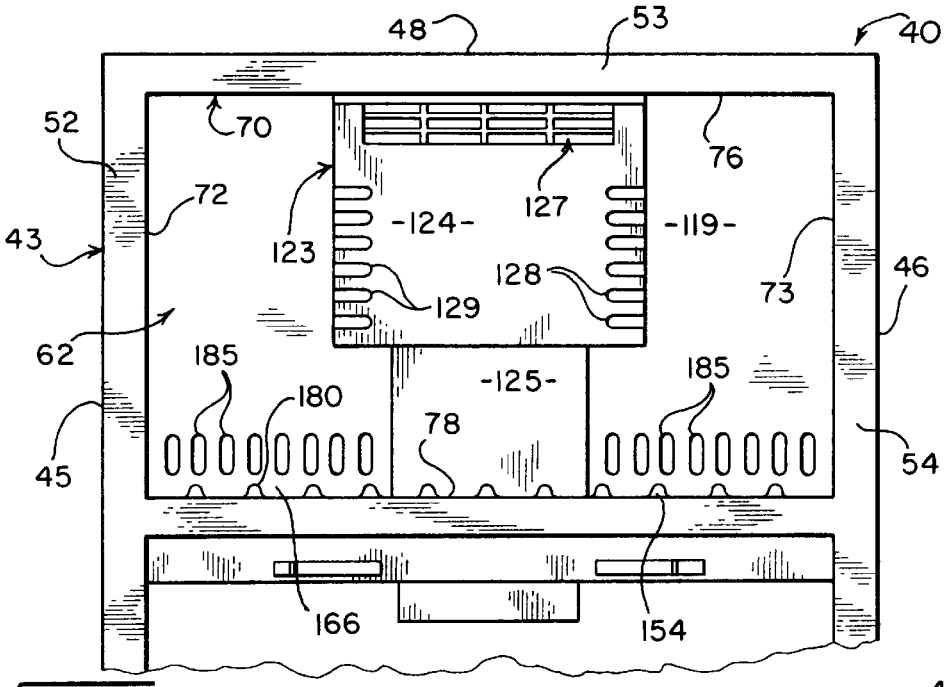
FIG. 2
FIG. 3
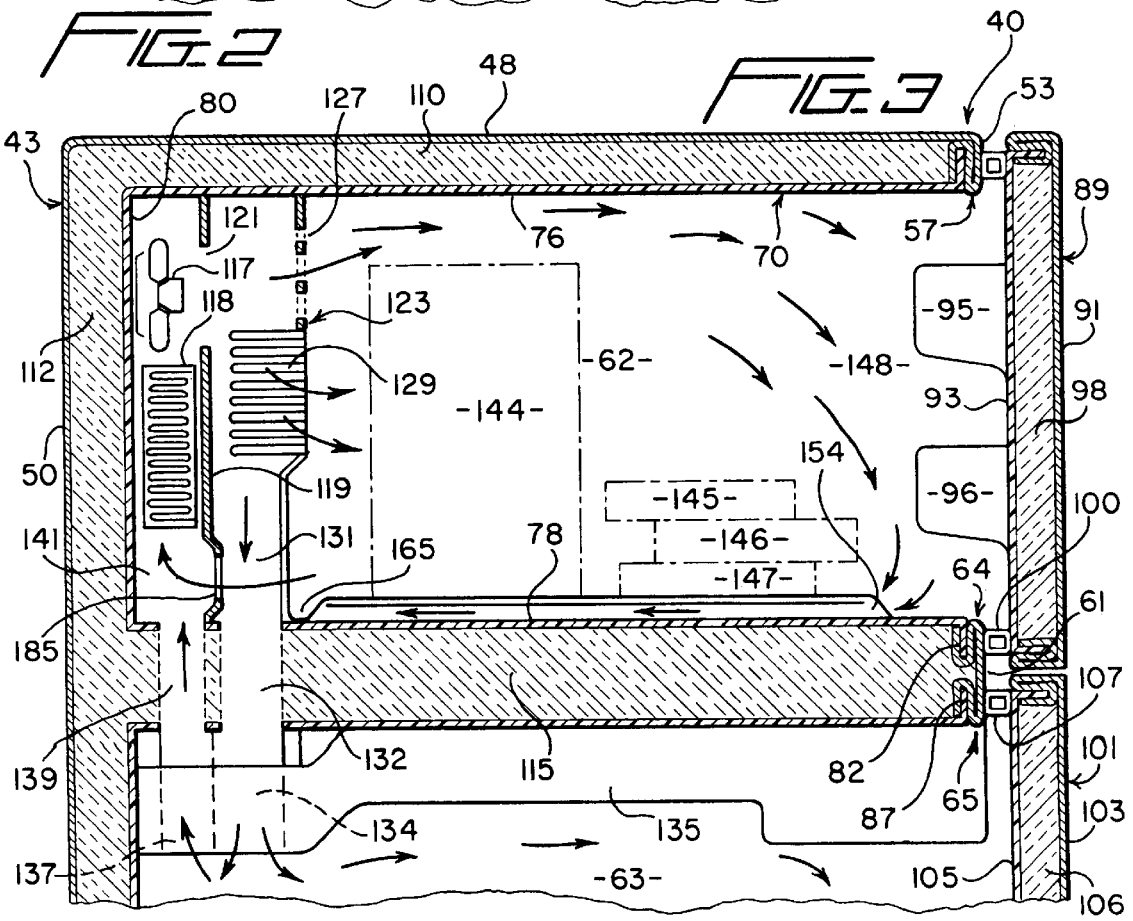

AIR FLOW SYSTEM FOR REFRIGERATOR FREEZER COMPARTMENT

BACKGROUND OF THE INVENTION

1. Field of the Invention

The present invention pertains to the art of refrigerators and, more particularly, to an air flow system for a freezer compartment of a refrigerator.

2. Discussion of the Prior Art

To maintain food storage zones at desired temperatures, a refrigerator will incorporate a system for generating a flow of cooling air which is delivered to various zones of the refrigerator and recycled for further cooling. As is known in the art, such a system includes a closed refrigeration circuit incorporating a compressor, a condenser, an evaporator and an expansion valve. In a typical refrigerator having both freezer and fresh food compartments, the system cycles to provide a supply of cooling air based on the position of one or more manual control knobs and sensed temperatures in the freezer and fresh food compartments. In many known refrigerator arrangements, the flow of cooling air is first delivered to the freezer compartment and then some of the air is diverted to the fresh food compartment. In other known refrigerator arrangements, the flow of cooling air is divided by suitable baffles or the like prior to entering either compartment, with the freezer receiving a higher percentage of the overall air flow.

In any case, the cooling air provided for the freezer compartment must enter the compartment through a suitable inlet, circulate through the compartment and exit the freezer compartment through an air outlet whereby the air can be either returned to the system for further cooling or discharged from the system. FIG. 1 illustrates a typical air flow arrangement for the freezer compartment of a household refrigerator. In this figure, a top mount refrigerator cabinet is generally indicated at 3. Cabinet 3 generally includes a shell 4, an upper freezer compartment 5 and a lower fresh food compartment 7, with the freezer and fresh food compartments 5 and 7 being separated by a mullion 8. Of course, cabinet 3 also includes a lower door 9, having a handle 11 for accessing fresh food compartment 7, and a freezer door (not shown). Freezer compartment 5 is defined by a pair of opposing side walls 15 and 16, a top wall 18, a bottom wall 20 and a rear wall 22, all of which are typically formed as a single liner member that is installed within shell 4 as a unit.

For receiving a flow of cooling air from a refrigeration system (not shown), rear wall 22 is formed, at an upper central portion thereof, with at least one air inlet 26. Air coming in through inlet 26 will flow generally along an upper portion of freezer compartment 5 toward a front portion thereof. The air will then be forced downward toward a set of air outlets or return vents 31 which extend laterally across freezer compartment 5 at the front of bottom wall 20 and lead into mullion 8. Therefore, bottom wall 20 actually defines a false bottom and mullion 8 provides a passageway for the return flow of the cooling air from freezer compartment 5. An example of such a known arrangement is represented in U.S. Pat. No. 3,107,502.

Such an air flow system suffers from various drawbacks. For instance, the vertical dimension of the mullion 8 must be enlarged to provide for the passageway therein while still having enough room for an adequate amount of insulation between freezer and refrigerator compartments 5 and 7. In addition, when multiple food items are stacked atop and in front of other items within freezer compartment 5, these other items may not be adequately cooled through convection as the cooling air will flow well above these items at the rear of freezer compartment 5 and will exit freezer compartment 5 when the flow reaches the lower front portion of freezer compartment 5. Since these conventional systems generally diffuse the air in all directions at the rear of the freezer compartment, they must rely upon the arrangement of the outlet or return vent in the front to get the needed circulation. Furthermore, one or more of the air outlets 31 can be covered by items placed in freezer compartment 5 which could affect the overall cooling system for the refrigerator.

Attempts have been made to improve on such an air flow system by re-positioning the air outlets to a lower rear portion of a freezer compartment. Unfortunately, when the freezer is packed rather heavily, the air must take meandering paths, often through extremely small gaps between the stored items, if it is to return to the outlets. U.S. Pat. Nos. 3,321,933 and 3,365,118 illustrate typical refrigerators of this type.

Based on the above, there exists a need in the art for an improved air flow system for a freezer compartment of a refrigerator. More specifically, there exists a need for a system which will provide for the proper circulation of cooling air within and through the freezer compartment to assure adequate convection cooling of items stored in the a compartment.

SUMMARY OF THE INVENTION

The invention is directed to an air flow system for a freezer compartment of a refrigerator wherein cooling air enters at a rear portion of the compartment, is caused to flow forwardly along upper and side portions thereof, is re-directed at a front portion of the compartment and flows rearward to air outlets through a plurality of channels defined between upstanding ribs projecting from a bottom wall or floor of the freezer compartment. More specifically, elongated air inlet openings are provided at upper rear portions of the freezer compartment. The openings are arranged to direct incoming cooling air both forward and upward at one upper central portion of the freezer compartment and forward and toward the side walls at another central portion of the freezer compartment. With this arrangement, the cooling air is caused to flow to the front of the freezer compartment in a substantially uniformly distributed manner.

At the front of the freezer compartment, the air flow is forced downward and then rearward while still being generally uniformly distributed across the width of the freezer compartment. Any items stored in the compartment will actually be supported upon the ribs, which are laterally spaced and extend from adjacent the front of the freezer compartment toward the rear thereof, and therefore the items will be spaced vertically from a plane defined by the bottom wall of the freezer compartment. This arrangement enables the air to flow, within the laterally spaced channels, beneath the stored items to provide additional convection cooling. The ribs preferably terminate at a position spaced from the rear of the storage area such that a lateral gap is formed which provides for a flow of cooling air across the lower rear portion of the compartment. The rear of the storage area is formed with various lower openings that define the air outlets for the freezer compartment.

From the above, it should be readily apparent that the air flow system of the present invention provides for a distributed flow of cooling air entering the freezer compartment and assures the presence of flow channels for the air to return to a lower rear outlet. In addition, the system is designed to provide for a lateral flow of cooling air along a lower rear portion of the freezer compartment. Therefore, in general, the invention provides an air flow system for a freezer compartment of a refrigerator that enhances the cooling thereof, thereby representing a more efficient and effective overall food storage arrangement.

Additional features and advantages of the invention will become more readily apparent from the following detailed description of a preferred embodiment thereof when taken in conjunction with the drawings wherein like reference numerals refer to corresponding parts in the several views.

BRIEF DESCRIPTION OF THE DRAWINGS

FIG. 2 is a partial front view of an air flow system for a refrigerator in accordance with the present invention; and FIG. 3 is a cross-sectional side view of the refrigerator cabinet of FIG. 2.

DETAILED DESCRIPTION OF THE PREFERRED EMBODIMENT

Figure 1:
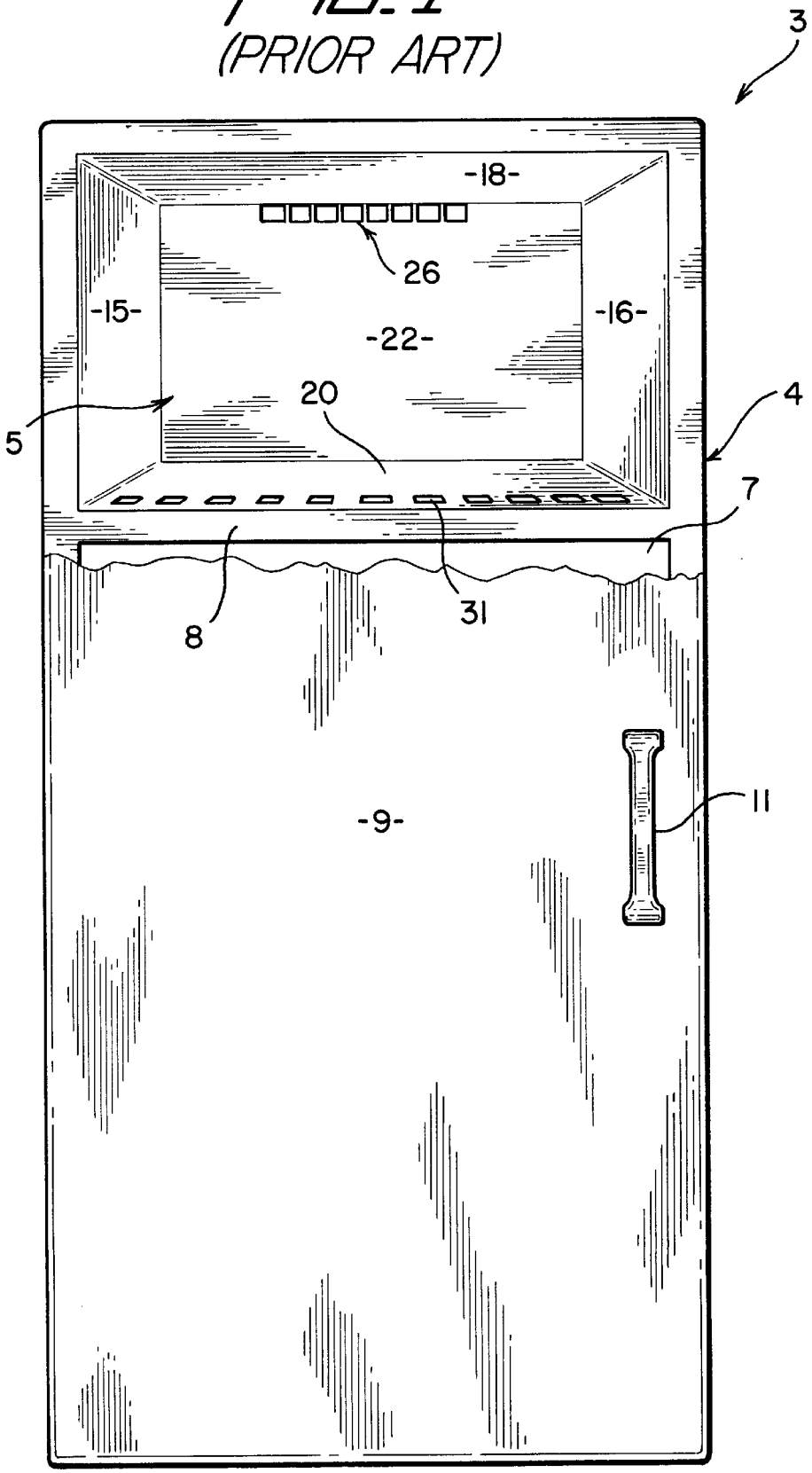
FIG. 1 (PRIOR ART)
FIG. 1 is a front view of a top mount refrigerator cabinet incorporating a freezer compartment air flow system constructed in accordance with the prior art.

With reference to FIGS. 2 and 3, a refrigerator cabinet incorporating the air flow system of the present invention is generally indicated at 40. Refrigerator cabinet 40 comprises an outer shell 43 including opposed side panels 45 and 46, a top panel 48 and a back panel 50. As is known in the art, side and top panels 45,46 and 48 are preferably bent from a single blank of sheet metal and back panel 50 is attached thereto by a welding and/or crimping process. Each of side and top panels 45,46 and 48 are first roll-formed to make face portions 52–54 of refrigerator cabinet 40 and then are roll-formed to create return flanges such as indicated at 57 in FIG. 3. Each return flange 57 defines a portion of a liner receiving cavity (not separately labeled). A mullion bar 61 is mounted across the front of shell 4 to aid in dividing refrigerator cabinet 40 into upper freezer and lower fresh food compartments 62 and 63 as will be discussed further below. Mullion bar 61 has associated upper and lower return flanges 64 and 65 which define respective liner receiving cavities (not separately labeled).

Within shell 43 is positioned a freezer liner 70. Freezer liner 70 is preferably integrally molded to define opposing side walls 72 and 73, a top wall 76, a bottom wall or floor 78 and a rear wall 80. An annular, out-turned flange 82 extends about the side, top and bottom walls 72, 73, 76 and 78 at the front of shell 43. Flange 82 is actually positioned within the liner receiving cavities defined by return flanges 57 and 64 when mounting freezer liner 70 within shell 43. A fresh food liner 85 is similar constructed with an out-turned flange 87 that is received within the liner receiving cavity of lower return flange 65, as well as additional receiving cavities (not shown) associated with shell 43. In general, the mounting of freezer liner 70 and fresh food liner 85 is known in the art and is merely mentioned here for the sake of completeness. Of course, it should be realized that other known liner arrangements, such as single piece and front loading arrangements, could be equally used in connection with the present invention.

In addition, as is further common in the art, refrigerator cabinet 40 is provided with a pivotally mounted freezer door 89 to provide access to food items stored within freezer compartment 62. Freezer door 89 is constituted by an outer panel 91, a door liner 93 provided with item supporting dike and shelves 95 and 96, foamed in-situ insulation 98 and an annular seal 100. In a similar manner, a refrigerator door 101 provides selective access to fresh food compartment 63 of refrigerator cabinet 40. Refrigerator door 101 also includes and outer panel 103, a door liner 105, insulation 106 and an annular seal 107. Since the particular structure and mounting of doors 89 and 101 are not considered part of the present invention and are widely known in the art, they will not be further discussed herein. As is farther known in the art, liners 70 and 85 are mounted such that a space is provided between the outer shell 43 and the liners 70 and 85. In addition, liners 70 and 85 are vertically spaced at the level of mullion bar 61 such that various insulation zones are established. FIG. 3 clearly illustrates at least an upper insulation zone 110, a rear insulation zone 112 and a mullion insulation zone 115.

The manner in which a flow of cooling air enters, circulates and then exits freezer compartment 62 in accordance with the present invention, as well as the manner in which a percentage of the cooling air is delivered to fresh food compartment 63, will now be described in detail. Mounted adjacent rear wall 80 at an upper rear portion of freezer liner 70 is a fan 117. Positioned below fan 117 is an evaporator 118. It should be readily recognized that evaporator 118 forms part of an overall refrigeration circuit and that fan 117 is utilized to develop a forced flow of cooling air for the refrigerator. Positioned in front of fan 117 and evaporator 118 is an evaporator cover 119 which extends from top wall 76 to bottom wall 78, as well as between opposing side walls 72 and 73. In this sense, evaporator cover 119 actually defines a rearmost wall for freezer compartment 62. Evaporator cover 119 is formed with an opening 121 that is arranged in front of fan 117 and through which cooling air can flow.

Mounted in a central portion of freezer compartment 62, forward of evaporator cover 119, is a freezer tower 123. Unlike evaporator cover 119, freezer tower 123 is preferably spaced a substantial distance inwardly from each of side walls 72 and 73 but does extend entirely between top wall 76 and bottom wall 78 of freezer liner 70. In the preferred embodiment shown, freezer tower 123 includes an upper section 124 and a lower section 125 which is narrow and slightly recessed relative to upper section 124. Freezer tower 123 is provided with a first set of air inlets 127 that extend laterally across an upper rear section of freezer compartment 62, as well as second and third sets of air inlets 128 and 129 which are spaced below the first set of air inlets 127 but which are still located a substantial distance above bottom wall 78.

Defined between evaporator cover 119 and freezer tower 123 is a cooling air delivery tunnel 131. Each of the first, second and third sets of air inlets 127–128 open up into cooling air delivery tunnel 131 and are therefore adapted to direct a flow of cooling air into freezer compartment 62 during operation of fan 117. Cooling air delivery tunnel 131 also extends downward and leads to a passage 132 extending through mullion insulation zone 115. Passage 132 is actually aligned with a passage 134 formed in a control housing 135 mounted within fresh food compartment 62. As the construction and operation of control housing 135 does not form part of the present invention, it will not be described herein. However, it should be noted that control housing 135 is also provided with a return passage 137 that is aligned with a passage 139 in mullion insulation zone 115. Passage 139 leads to a return channel 141 that is defined between rear wall 80 and evaporator cover 119.

With this construction, operation of fan 117 will develop a forced flow of cooling air that is drawn across evaporator 118 and which flows through opening 121 and into cooling air delivery tunnel 131. A majority of this air is directed into the storage area of freezer compartment 62 through the first, second and third sets of air inlets 127–129 formed in freezer tower 123. In the preferred embodiment, the supply of cooling air delivered through the centermost openings of the first set of air inlets 127 is directed forward and toward the top wall 176 and the outermost openings associated with the first set of air inlets 127, as well as the second and third sets of air inlets 128 and 129, generally direct a flow of air forward and toward opposing side walls 72 and 73. Of course, the particular location and arrangement of air inlets 127–129 can vary without departing from the spirit of the invention. Some of the cooling air flowing through delivery tunnel 131 will extend through passages 132 and 134 and into fresh food compartment 63. Passage 134 preferably directs the flow of air both forwardly and rearwardly as indicated by the arrows in FIG. 3 in order to avoid stratification of the fresh food compartment 63. Return air flow from fresh food compartment 63 is directed into return passage 137, passage 139 and into return channel 141. This air is then caused to recirculate over the coils of evaporator 118.

Again, the exact shape and configuration of air inlets 127–129 can vary in accordance with the present invention and are designed to create a substantially uniform flow of cooling air that is directed into an upper portion of freezer compartment 62. With this arrangement, the air will be free to flow over any food items stored in freezer compartment 62, such as items 144–147, as indicated by the arrows in FIG. 3. When the flow of cooling air reaches a front portion 148 of freezer compartment 62, the air will be forced to re-direct its flow path. More specifically, the air will tend to flow downwardly and reverse its direction. Of course, the food items 144–147 will tend to obstruct the free flow of air back to evaporator cover 119. Therefore, in accordance with the invention, bottom wall 78 is provided with a plurality of upstanding ribs, one of which is indicated at 154. In the preferred embodiment, ribs 154 are laterally spaced and extend longitudinally within freezer compartment 62 from a position spaced from evaporator cover 119, so as to define an air gap 165 that extends laterally between side walls 72 and 73, to the front portion 148 of freezer compartment 62. Since ribs 154 are laterally spaced from each other and side walls 72 and 73, a plurality of channels 166 are defined that extend from the front portion 148 to gap 165. Each rib 154 has an associated upper surface 180, that is preferably flat but which could be arcuate, upon which items 144–147 are supported. Therefore, items 144–147 are supported above a lowermost plane defined by bottom wall 78 and channels 166 are always open to permit the flow of air back toward evaporator cover 119. Of course, when the cooling air flows through channels 166, the lowermost items 144 and 147 will be contacted by an additional flow of cooling air.

At a lower rear portion of freezer compartment 62, a plurality of air outlets or returns 185 are provided. Air outlets 185 are preferably constituted by elongated, laterally spaced slots 187 that are arranged on either side of freezer tower 123. Like passage 139, outlets 185 lead to return channel 141 and therefore function to recirculate the air over the coils of evaporator 118. Again, the size and shape of outlets 185 can vary in accordance with the present invention, but it is important to note that they are located directly adjacent bottom wall 78 in order to provide for a continuous, smooth and efficient flow of cooling air through freezer compartment 61 that is assured due to the presence of ribs 154 and the formation of channels 166.

From the above description, it should be readily apparent that the air flow system of the invention provides for an effective flow and distribution of cooling air through the freezer compartment, even when numerous food items are placed in front of the air outlets or returns. However, although described with respect to a preferred embodiment thereof, it should be realized that various changes and/or modifications may be made to the invention without departing from the spirit thereof. For example, although evaporator 118 is shown mounted adjacent rear wall 80 of freezer liner 70, evaporator 118 could also be mounted within the mullion area and below a false freezer bottom of refrigerator cabinet 40 in a manner also known in the art, particularly if an increase in the depth of freezer compartment 62 is needed. In any event, in general, the invention is only intended to be limited by the scope of the following claims.

We claim:

1. In a refrigerator including a freezer compartment having a freezer storage area defined by opposing side walls, a bottom wall, a rear wall, a top wall and an open font portion adapted to be selectively closed by positioning a pivotable door thereacross, an airflow system for said freezer compartment comprising:

at least one air inlet opening into an upper rear portion of the freezer storage area;

at least one air outlet leading from the freezer storage area at a lower rear portion thereof; and plurality of ribs upon which food items to be placed in the freezer storage area are adapted to be supported, extending longitudinally along said bottom wall from adjacent said front portion toward said rear wall, said ribs being laterally spaced so as to define a plurality of channels therebetween, wherein cooling air is permitted to circulate through the freezer storage area by entering the at least one air inlet, flowing along an upper portion of the freezer storage area towards said front portion, being re-directed at said front portion, flowing rearward within said channels and exiting the freezer storage area through the at least one air outlet.

2. The air flow system according to claim 1, wherein said ribs terminate at a position spaced from said rear wall such that an air gap is defined between said rear wall and said ribs.

3. The air flow system according to claim 2, wherein the air gap extends substantially entirely between said opposed side walls.

4. The air flow system according to claim 2, wherein the at least one air inlet and the at least one air outlet extend laterally across a substantial portion of the rear wall.

5. The air flow system according to claim 1, further comprising an evaporator cover that defines the rear wall of the freezer storage area, with the at least one air outlet being formed in the evaporator cover.

6. The air flow system according to claim 5, further comprising a freezer tower mounted in the freezer compartment forward of the evaporator cover, with the at least one air inlet being formed in the freezer tower.

7. The air flow system according to claim 6, wherein the at least one air inlet is constituted by first, second and third sets of spaced openings leading into the freezer storage area, with at least the first set of openings directing the cooling air upwardly and forwardly within the freezer storage area.

8. The air flow system according to claim 7, wherein at least the second and third sets of openings extend along side portions of the freezer tower.

9. In a refrigerator including a freezer compartment having a freezer storage area defined by a liner having opposing side walls, a bottom wall, upon which food items to be placed in the freezer storage area are adapted to be supported a rear wall, a top wall and an open front portion adapted to be selectively closed by positioning a pivotable door thereacross, an air flow system for said freezer compartment comprising:

a plurality of air inlets opening into an upper rear portion of the freezer storage area, with a majority of said plurality of air inlets being angled so as to direct cooling air forward and toward said top wall, while some of said plurality of air inlets are angled so as to direct cooling air forward and toward a respective one of said side walls; and at least one air outlet leading from said freezer compartment at a lower rear portion thereof.

10. The air flow system according to claim 9, further comprising a plurality of ribs extending longitudinally along said bottom wall from adjacent said front portion toward said rear wall, said ribs being laterally spaced so as to define a plurality of channels therebetween, wherein cooling air is permitted to circulate through said freezer storage area by entering said air inlet, flowing along an upper portion of said freezer storage area towards said front portion, being re-directed at said front portion, flowing rearward within said channels and exiting said freezer storage area through said air outlet.

11. The air flow system according to claim 10, wherein said ribs terminate at a position spaced from said rear wall such that an air gap is defined between said rear wall and said ribs.

12. The air flow system according to claim 11, wherein the air gap extends substantially entirely between said opposed side walls.

13. The air flow system according to claim 9, further comprising a freezer tower that partitions off a portion of said freezer compartment, said plurality of air inlets being formed in said freezer tower.

14. The air flow system according to claim 13, further comprising an evaporator cover defining the rear wall, with the at least one air outlet being formed in the evaporator cover.

15. A method of providing circulating air flow through a freezer storage area of a refrigerator comprising:

introducing an inlet flow of cooling air into said freezer storage area at an upper rear portion thereof;

directing the cooling air to flow along an upper portion of said freezer storage area towards a front portion of said freezer storage area;

re-directing the cooling air at said front portion;

channeling the cooling air to flow rearward between laterally spaced and longitudinally extending ribs upon which food items to be placed in the freezer storage area are adapted to be supported which extend upwardly from a bottom wall of said freezer storage area; and permitting the cooling air to exit the freezer storage area through an air outlet provided at a lower rear portion of the freezer storage area.

16. The method according to claim 15, further comprising:

circulating cooling air along a junction of the bottom wall and a rear wall of the freezer storage area by terminating the ribs at a distance spaced from the rear wall such that a lateral gap is provided at the lower rear portion of said freezer storage area.

17. The method according to claim 15, further comprising: directing a portion of the inlet flow of cooling air forward and toward upper side wall portions of said freezer storage area.

* * * * *